US005867185A

United States Patent [19]

Yun

[11] Patent Number: 5,867,185

[45] Date of Patent: Feb. 2, 1999

[54] WIPER AND CAP PART OF AN INKJET PRINTER SERVICE STATION

[75] Inventor: Seuk-jin Yun, Kyungki-do, Rep. of Korea

[73] Assignee: Samsung Electronics Co., Ltd., Rep. of Korea

[21] Appl. No.: 778,823

[22] Filed: Jan. 3, 1997

[30] Foreign Application Priority Data

Sep. 1, 1996 [KR] Rep. of Korea ..... 96-261

[51] Int. Cl.[6] ..... B41J 2/165

[52] U.S. Cl. ..... 347/29; 347/32

[58] Field of Search ..... 347/33, 22, 32, 347/29

[56] References Cited

U.S. PATENT DOCUMENTS 5,677,715 10/1997 Beck ..... 347/29

FOREIGN PATENT DOCUMENTS 60-224550 11/1985 Japan ..... 347/29
61-228961 10/1986 Japan ..... 347/29
62-77943 4/1987 Japan ..... 347/33

*Primary Examiner*—S. Lee
*Attorney, Agent, or Firm*—Banner & Witcoff, Ltd.

[57] ABSTRACT

A service station device of a head for inkjet printer placed out of a printing area includes a wiper for cleaning the head, an operating lever operated by a carriage part moved to a service area, an elastic member for returning the operating lever when the carriage part is moved to a printing area, a rotating force transmitting part for changing the movement of the operating lever into a rotating force to transmit it, and a cap part reciprocating by the rotating force to be in contact with a head surface by ascending when the carriage part is moved to the service area. Here, a driving part for driving the wiper and cap is formed by a cleaning part having a wiper gear, the operating lever and the wiper, and a closing part having a cap gear, a vertical rack and the cap. A carriage moved side to side is utilized during printing to sequentially carry out the cleaning and closing functions. Thus, the structure is simplified and the assembling operation is shortened to improve the manufacturing efficiency while economizing the cost. Also, the simplified driving part enables to contrive minimization of the printer, and the stroke span of the driving part becomes short to reduce the cleaning and closing operation time, thereby devising fast printing operation and providing the inkjet printer with improved function.

8 Claims, 7 Drawing Sheets

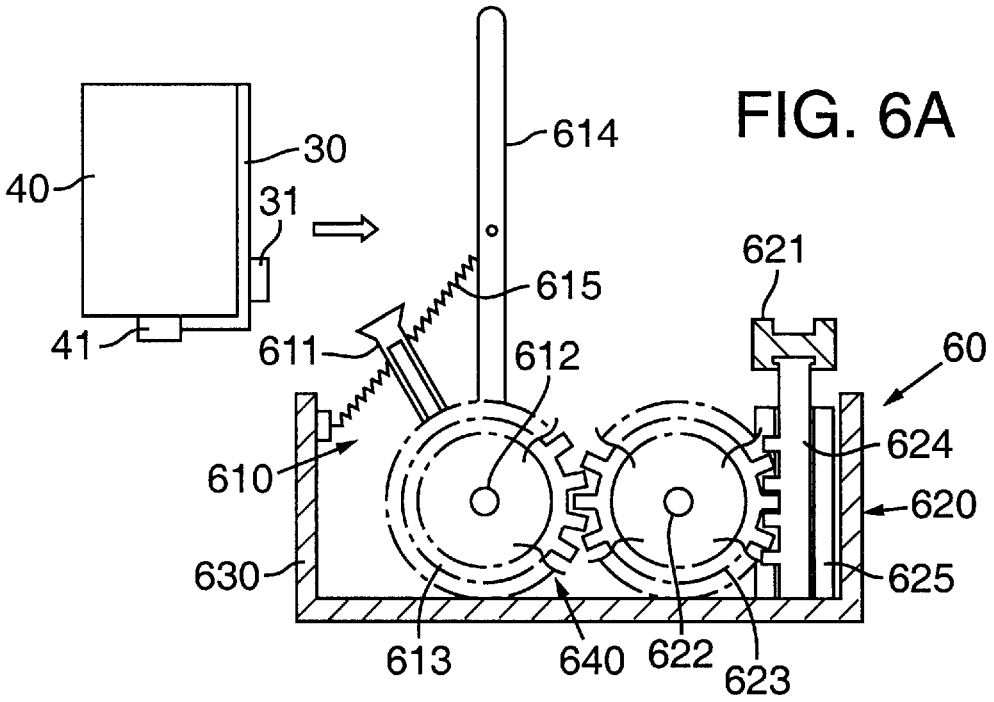
FIG. 6A
FIG. 6B
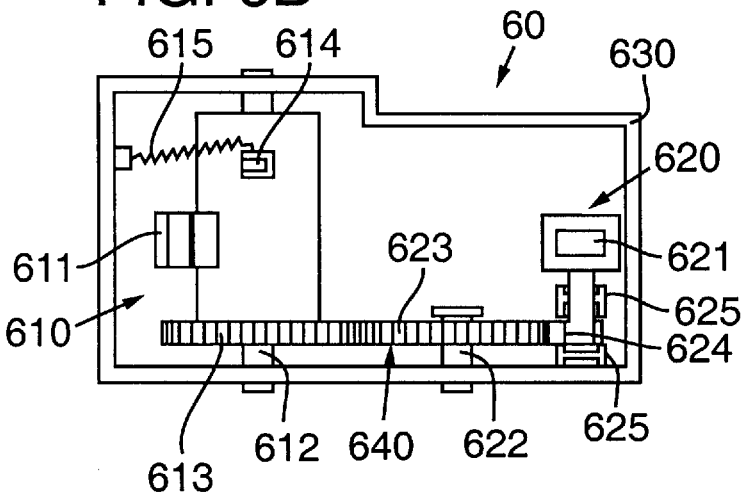

WIPER AND CAP PART OF AN INKJET PRINTER SERVICE STATION

BACKGROUND OF THE INVENTION

1. Field of the Invention

The present invention relates to a head of an inkjet printer, and more particularly to an improved service station device of a head for inkjet printer, wherein a stroke span of cleaning and capping operations of a head nozzle is minimized for shortening a printing operation time and simplifying the structure, thereby assisting to accomplish minimization of the printer.

2. Description of the Prior Art

An inkjet printer is formed by a carriage which is moved side to side by means of a timing belt under a guidance of a timing pulley installed onto a main frame, and a head which is mounted to the carriage for ejecting ink while being moved together with the carriage. Also, a nozzle installed to the head for issuing the ejected ink to have a prescribed pattern, and a service station part for wiping out or closing off the head in accordance with a cleaning signal at constant intervals during performing the printing are provided.

The service station part includes, as shown in FIG. 1, a forward/backward driving motor 650 fixedly installed to the outer side of a driving main body 640 to be driven, and a worm gear 660 fixedly installed to forward/backward driving motor 650 in a body to be rotated forward/backward by the driving force. In addition to these, a screw shaft 670 is rotated by being perpendicularly erected with respect to driving main body 640, and a worm wheel 680 integrally formed to the lower end of screw shaft 670 receives the driving force of worm 660 for forward/backward rotating screw shaft 670. A vertical operation unit 690 is screw-coupled to screw shaft 670 to ascend/descend in accordance with the rotating direction of screw shaft 670, and a see-saw stand 700 installed to a case 630 by means of a shaft pin 701 to be rotatable has one end connected to the free end of vertical operation unit 690 for performing the see-saw motion at both ends thereof. A wiper 611 and a cap 621 are respectively fixed to both upper ends of see-saw stand 700 for cleaning or closing nozzle 41 of head 40.

Since the printing operation is carried out by ejecting the ink via nozzle 41 (having a caliber of 5/100 mm) of head 40, the service station part functions for cleaning out nozzle 41 of head 40 and closing nozzle 41 before/after performing the printing to inhibit the ink from being hardened at nozzle 41 when the printing is not performed.

FIG. 2A shows a neutral state during the printing, in which wiper 611 and cap 621 commonly maintain the level with each other.

FIG. 2B shows an operating procedure when cleaning nozzle 41, in which, after the carriage mounted with head 40 performs the printing operation via nozzle 41 of head 40 while being moved side to side, forward/backward driving motor 650 is driven forward in accordance with a signal when the carriage is moved to a service area to be adjacent to the service station part for preparing the succeeding printing operation. Then, the resulting driving force rotates screw shaft 670 via worm 660 and worm wheel 680, and screw-coupled vertical operation unit 690 is moved downward along the spiral direction by the rotation of screw shaft 670. Along with the descending operation of vertical operation unit 690, see-saw stand 700 connected thereto performs the see-saw motion centering about shaft pin 701 to ascend wiper 611 and to descend cap 621. Therefore, nozzle 41 of head 40 is cleaned by ascending wiper 611.

FIG. 2C shows an operating procedure of closing nozzle 41, in which nozzle 41 cleaned by wiper 611 is continuously moved toward cap 621. Then, forward/backward driving motor 650 is driven by a signal in the direction reverse to the above-described operation, and the resulting driving force rotates screw shaft 670 in the direction reverse to the above-described operation via worm 660 and worm wheel 680. By the reverse rotating motion of screw shaft 670, screw-coupled vertical operation unit 690 is moved upward along the spiral direction. Then, the ascension of vertical operation unit 690 induces the see-saw motion of see-saw stand 700 connected thereto by centering about shaft pin 701, so that wiper 611 descends and cap 621 ascends. Therefore, nozzle 41 of head 40 is covered by ascending cap 621 to be closed.

However, the foregoing service station part has the following problems.

First, the driving part for driving to operate wiper 611 and cap 621 such as driving main body 640, forward/backward driving motor 650, worm 660, worm wheel 680, screw shaft 670, vertical operation unit 690 is required to complicate the structure. Consequently, the assembling process is added to degrade production efficiency and to increase cost. Furthermore, such a driving part requires a relatively wider installation space within the printer to enlarge the dimensions of the printer.

Second, the carriage is stopped so as to operate wiper 611 and cap 621, respectively. Therefore, the stroke time of the driving part is lengthened to slow down the cleaning and closing operation times.

SUMMARY OF THE INVENTION

The present invention is devised to solve the foregoing problems. Therefore, it is an object of the present invention to provide a service station device of a head for inkjet printer for minimizing a stroke span of cleaning and capping operations of a nozzle to shorten a printing time and, at the same time, to contrive minimization of the printer by simplifying the structure.

To achieve the above object of the present invention, an inkjet printer according to the present invention includes a carriage moved side to side by means of a timing belt under the guidance of timing pulley which is installed onto a main frame, and a head installed with a nozzle for ejecting ink in a constant pattern while being mounted to the carriage to be moved together with the carriage. Also, a service station part is placed to a service area for wiping out or closing off the nozzle of head at prescribed periods in accordance with a cleaning signal.

Here, a characteristic of the present invention is in that the service station device of the inkjet printer is constructed by a cleaning part installed with a wiper for cleaning the nozzle of head loaded onto the carriage which is moved to the service area for performing the succeeding printing operation, and an operating lever operated by the pressurizing force of the continuously moving carriage. Additionally, an elastic member returns the operating lever when the carriage is moved to a printing area for performing the printing operation, a rotating force transmitting part converts the operation of the operating lever into a rotating force to transfer it, and a closing part equipped with a cap for closing the nozzle of head is moved to the service area while carrying out the reciprocating motion up and down by means of the rotating force transmitted from the rotating force transmitting part.

The cleaning part is operated by the fixing system or by the leaping out system.

In association with the fixing system, the wiper is integrally assembled with the case to clean the nozzle of head which is horizontally moved.

In association with the leaping out system, the wiper is integrally formed to upwardly extend from one side of a wiper gear to allow the wiper to leap out during rotating the wiper gear, thereby cleaning the nozzle of head.

The operating lever is integrally assembled with the wiper gear to one side of the wiper gear to be spaced apart from each other by as many as a preset angle, thereby being pushed by the contact with the carriage which is moved to the service area to rotate the wiper gear.

It is preferable that the contact portion of the carriage and operating lever is distanced from the operating lever to be farther than the contact portion of the wiper and nozzle so as to allow the contact speed of the wiper and nozzle to exceed a preset level.

A coil spring is adopted as the elastic member in the present invention, which may be replaced with any one provided that the same operating effect is afforded.

The elastic member has both ends respectively fixed to the case and operating lever for serving for smoothly returning the operating lever when the carriage is moved to the printing area for performing the printing operation.

The rotating force transmitting part is formed by a gear group consisting of a plurality of gears to convert the operation of the operating lever into the rotating force to permit the cap to leap out up and down.

The rotating force transmitting part includes a wiper gear installed to the case for being rotatable about a shaft pin, and a cap gear installed to the case for rotating about a shaft pin and being brought into meshing engagement with the wiper gear to rotate reversely, thereby reciprocating the cap up and down.

A decelerating unit may be installed for controlling the ascending speed of the cap.

The decelerating unit is formed by a first decelerating gear brought into meshing engagement with the wiper gear between the wiper gear and cap gear for receiving the rotating force to decelerate the rotating speed. Also, a transmission gear integrally formed with the first decelerating gear is installed to be rotatable about a shaft rod of the case, and a second decelerating gear installed to be rotatable about a shaft pin is brought into meshing engagement with the transmission gear for further decreasing the rotating speed of the first decelerating gear to transfer the rotating force to the cap gear. By this construction, the horizontally transferred nozzle and upwardly moved cap are matched to each other.

The first decelerating gear and second decelerating gear of the decelerating unit and wiper gear are provided to make the diameter and gear number have the proportional relation that wiper gear<first decelerating gear<second decelerating gear, thereby decelerating the rotating speed. Otherwise, they are provided to belong to one another contrarily.

The gear group of the rotating force transmitting part may be formed such that the gears are formed to only one portions brought into meshing engagement with each other.

The closing part is formed by a vertical rack which is integrally fixed with the cap at the upper end thereof for ascending/descending in accordance with the rotating direction of the cap gear to be brought into meshing engagement with the cap gear to close the nozzle of head moved. Additionally, a guide is integrally fixed to the case for being placed to both sides of the vertical rack to accurately guide the ascending/descending motion in the vertical direction.

Preferably, a rubber substance is utilized for the wiper and cap applied to the present invention to prevent the damage upon the nozzle and, simultaneously, to enhance the cleaning and closing effects.

BRIEF DESCRIPTION OF THE DRAWINGS

The above objects and other advantages of the present invention will become more apparent by describing in detail preferred embodiments thereof with reference to the attached drawings in which:

FIG. 6 is views, with portions broken away, showing the structure of the service station device according to a second embodiment of the present invention, wherein (A) is a vertical section view, and (B) is a plan view.

DETAILED DESCRIPTION OF THE PREFERRED EMBODIMENTS

A service station device of a head for inkjet printer according to the present invention will be described in detail with reference to accompanying drawings.

Figure 1:
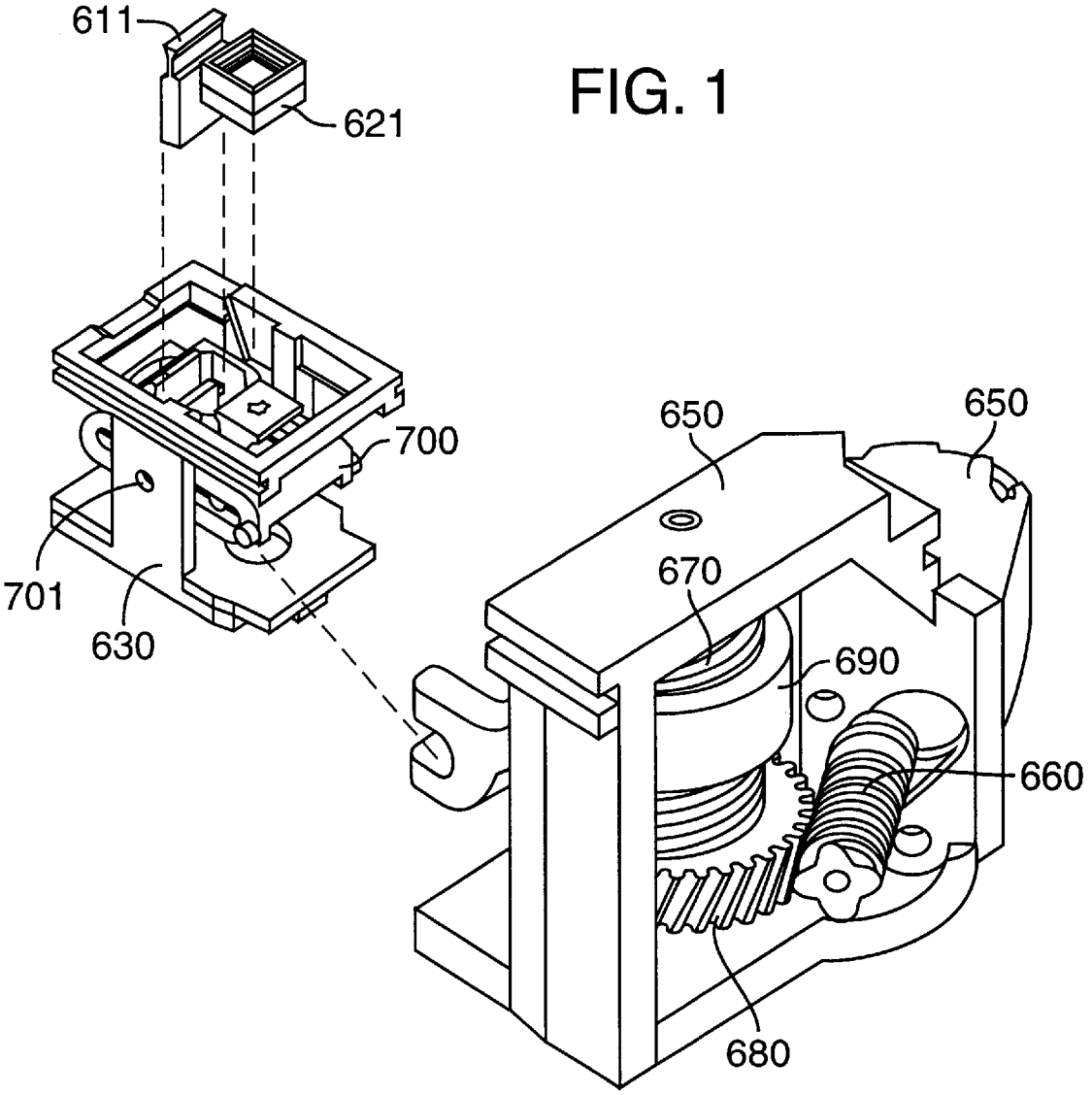
FIG. 1 is an exploded perspective view showing a service station part of a head according to a conventional technique.
Figure 2A:
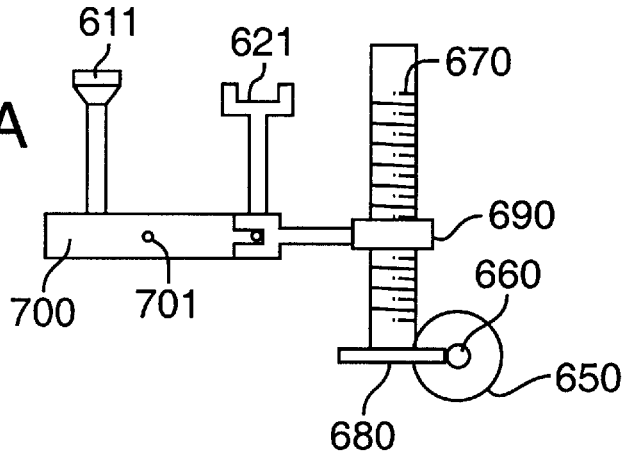
FIG. 2 is views for showing operational states of the service station part of the head according to the conventional technique, wherein (A) is a view showing a neutral state when performing the printing operation, (B) is a view showing a cleaning state, and (C) is a view showing a capping state.
Figure 2B:
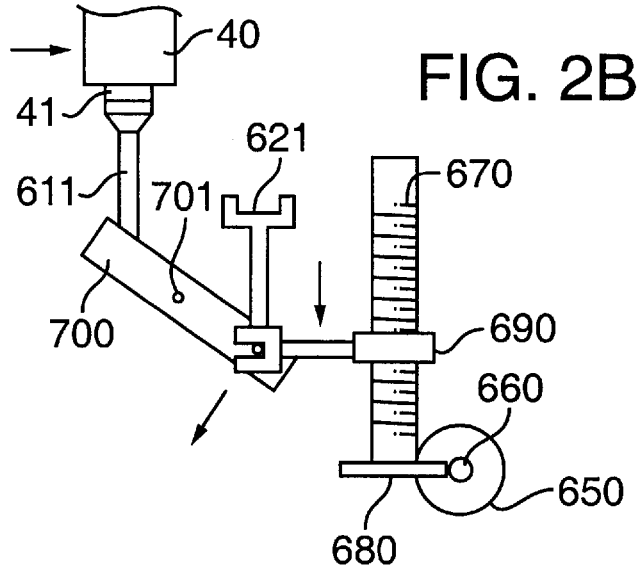
Figure 2C:
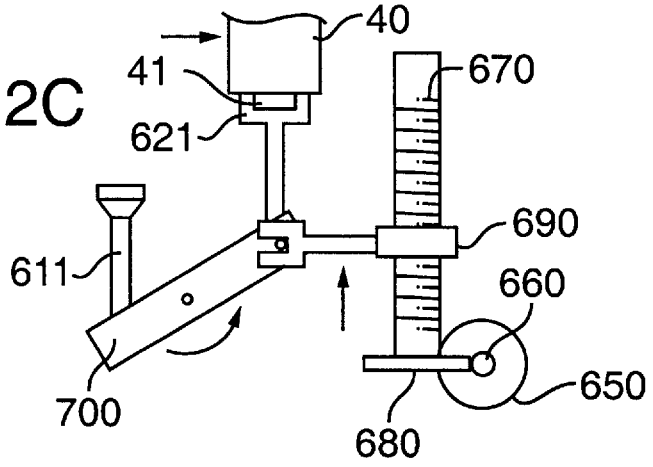
Figure 3:
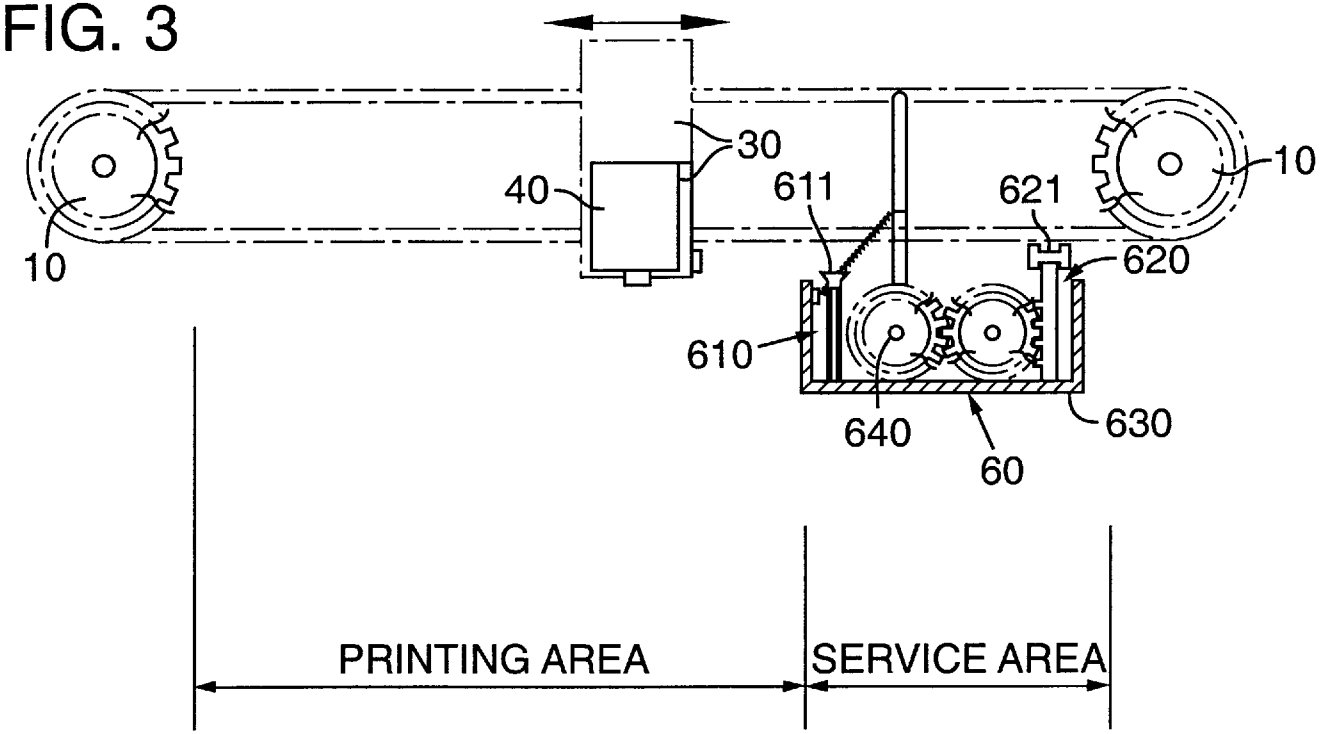
FIG. 3 is a diagrammatic view showing a structure of an inkjet printer representing the installation position of a service station device according to the present invention.
Figure 4A:
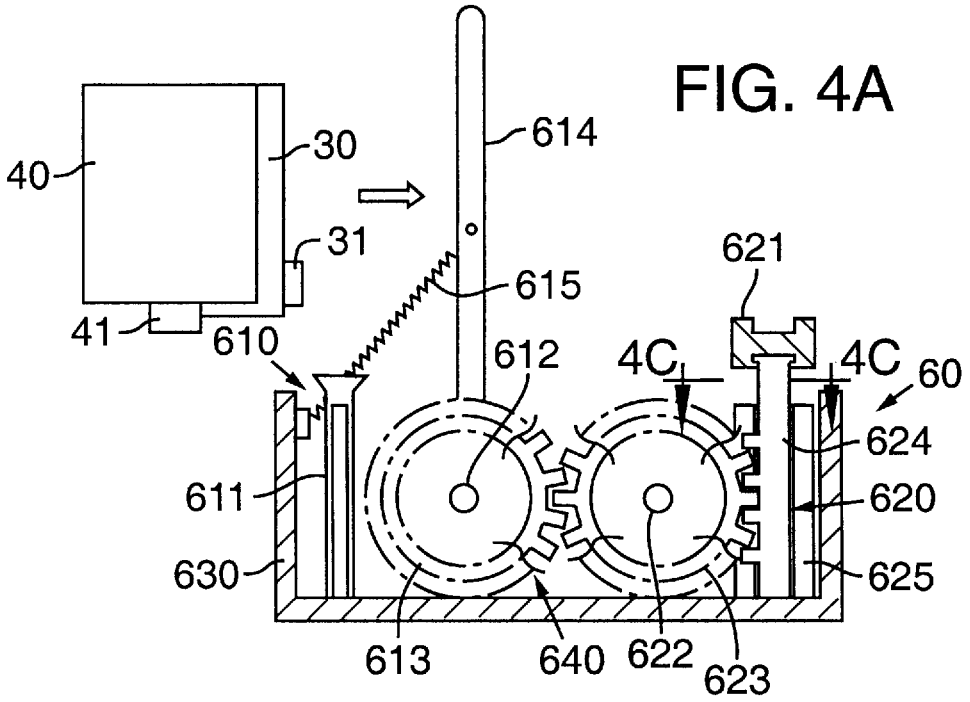
FIG. 4 is views, with portions broken away, showing the structure of the service station device according to a first embodiment of the present invention, wherein (A) is a vertical section view, (B) is a plan view, and (C) is a sectional view taken along line A—A of FIG. 4A.
Figure 4B:
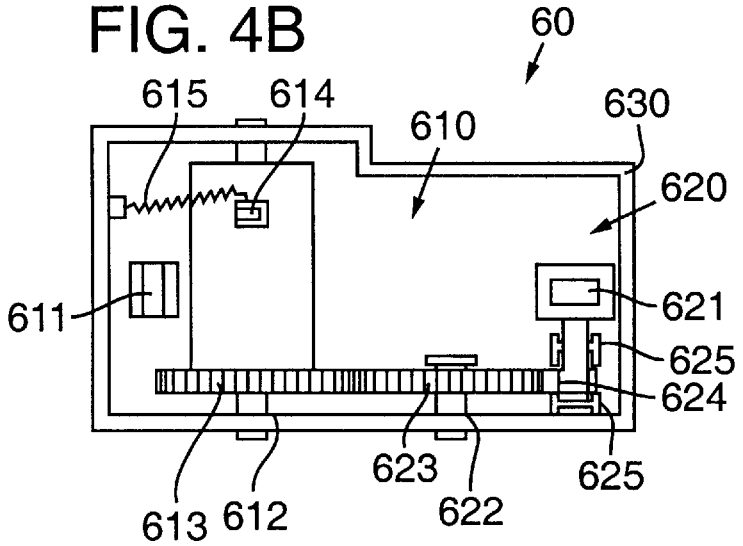
Figure 4C:
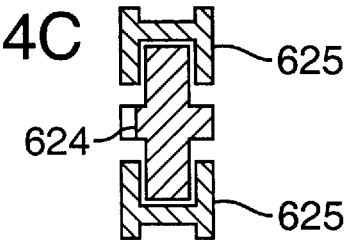

Referring to FIGS. 3 and 4 which illustrate a first embodiment of the present invention, the inkjet printer according to the present invention includes a carriage 30 moved side to side by means of a timing belt 20 under the guidance of timing pulley 10 which is installed onto a main frame, and a head 40 installed with a nozzle 41 for ejecting ink in a constant pattern while being mounted to carriage 30 to be moved together with carriage 30. Also, a service station part 60 is placed to a service area for wiping out or closing off nozzle 41 of head 40 at prescribed periods in accordance with a cleaning signal.

Here, a characteristic of the present invention is in that the service station device of the inkjet printer is constructed by a cleaning part 610 installed with a wiper 611 for cleaning nozzle 41 of head 40 loaded onto carriage 30 which is moved to the service area for performing the succeeding printing operation, and an operating lever 614 operated by the pressurizing force of continuously moving carriage 30. Additionally, an elastic member 615 returns operating lever 614 when carriage 30 is moved to a printing area for performing the printing operation, a rotating force transmitting part 640 converts the operation of operating lever 614 into a rotating force to transfer it, and a closing part 620 equipped with a cap 621 for closing nozzle 41 of head 40 is moved to the service area while carrying out the reciprocating motion up and down by means of the rotating force transmitted from rotating force transmitting part 640.

Carriage 30 may directly pushes operating lever 614, or a pressurizing lug 31 protrudes from the front plane thereof to push operating lever 614.

Cleaning part 610 is operated by the fixing system designated in the first embodiment or by the leaping out system designated in the second embodiment.

In association with the fixing system, as shown in FIG. 4, wiper 611 is integrally assembled with case 630 to clean nozzle 41 of head 40 which is horizontally moved.

In association with the leaping out system, as shown in FIG. 6, wiper 611 is integrally formed to upwardly extend from one side of a wiper gear 613 to allow wiper 611 to leap out during rotating wiper gear 613, thereby cleaning nozzle 41 of head 40.

Operating lever 614 is integrally assembled with wiper gear 613 to one side of wiper gear 613 to be spaced apart from each other by as many as a preset angle, thereby being pushed by the contact with carriage 30 which is moved to the service area to rotate wiper gear 613.

It is preferable that the contact portion of carriage 30 and operating lever 614 is distanced from operating lever 614 to be farther than the contact portion of wiper 611 and nozzle 41 so as to allow the contact speed of wiper 611 and nozzle 41 to exceed a preset level.

A coil spring is adopted as elastic member 615 in the present invention, which may be replaced with any one provided that the same operating effect is afforded.

Elastic member 615 has both ends respectively fixed to case 630 and operating lever 614 for serving for smoothly returning operating lever 614 when carriage 30 is moved to the printing area for performing the printing operation.

Rotating force transmitting part 640 is formed by a gear group consisting of a plurality of gears to convert the operation of operating lever 614 into the rotating force to permit cap 621 to leap out up and down. Rotating force transmitting part 640 includes a wiper gear 613 installed to case 630 for being rotatable about a shaft pin 612, and a cap gear 623 installed to case 630 for rotating about a shaft pin 622 and being brought into meshing engagement with wiper gear 613 to rotate reversely, thereby reciprocating cap 621 up and down.

Figure 8:
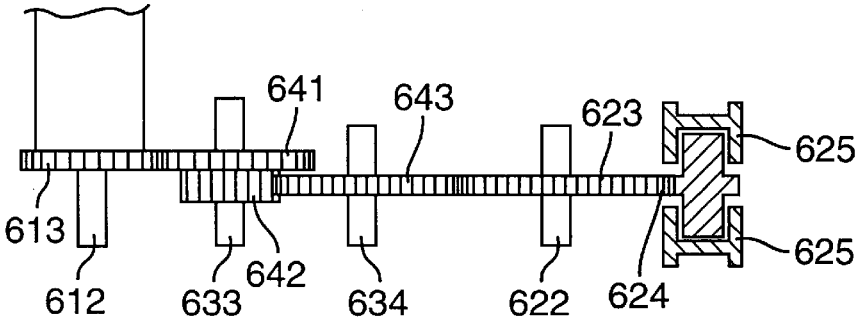
FIG. 8 is a plan view showing the major portions of another embodiment of the rotating force transmitting part according to the present invention.

A decelerating unit as shown in FIG. 8 may be installed in place of the gear group for controlling the ascending speed of cap 621.

That is, the decelerating unit is formed by a first decelerating gear 641 brought into meshing engagement with wiper gear 613 between wiper gear 613 and cap gear 623 for receiving the rotating force to decelerate the rotating speed. Also, a transmission gear 642 integrally formed with first decelerating gear 641 is installed to be rotatable about a shaft rod 633 of case 630, and a second decelerating gear 643 installed to be rotatable about a shaft pin 634 is brought into meshing engagement with transmission gear 642 for further decreasing the rotating speed of first decelerating gear 641 to transfer the rotating force to cap gear 623. By this construction, horizontally transferred nozzle 41 and upwardly moved cap 621 are matched to each other.

First decelerating gear 641 and second decelerating gear 643 of the decelerating unit and wiper gear 613 are provided to make the diameter and gear number have the proportional relation that wiper gear 613<first decelerating gear 641<second decelerating gear 643, thereby decelerating the rotating speed.

The foregoing decelerating unit according to the present invention is not solely adopted as rotating force transmitting part 640, but a speed-augmenting (or accelerating) unit may be applied as required. This is because both decelerating and accelerating units can be applied for accurately matching the moving speeds of horizontally-moved nozzle 41 and upwardly-moved cap 621.

Closing part 620 according to the present invention is formed by a vertical rack 624 which is integrally fixed with cap 621 at the upper end thereof for ascending/descending in accordance with the rotating direction of cap gear 623 to be brought into meshing engagement with cap gear 623 to close nozzle 41 of head 40 moved. Additionally, a guide 625 is integrally fixed to case 630 for being placed to both sides of vertical rack 624 to accurately guide the ascending/descending motion in the vertical direction.

Preferably, a rubber substance is utilized for wiper 611 and cap 621 applied to the present invention to prevent the damage upon nozzle 41 and, simultaneously, to enhance the cleaning and closing effects.

The service station device according to the present invention constructed as above is operated and effected as follows.

FIG. 4 showing a first embodiment of the present invention represents a neutral state during performing the printing operation, in which operating lever 614 is perpendicularly erected by means of elastic member 615, and wiper 611 is fixedly installed to case 630 to be erected vertically. Also, cap 621 maintains the descending state.

Figure 5A:
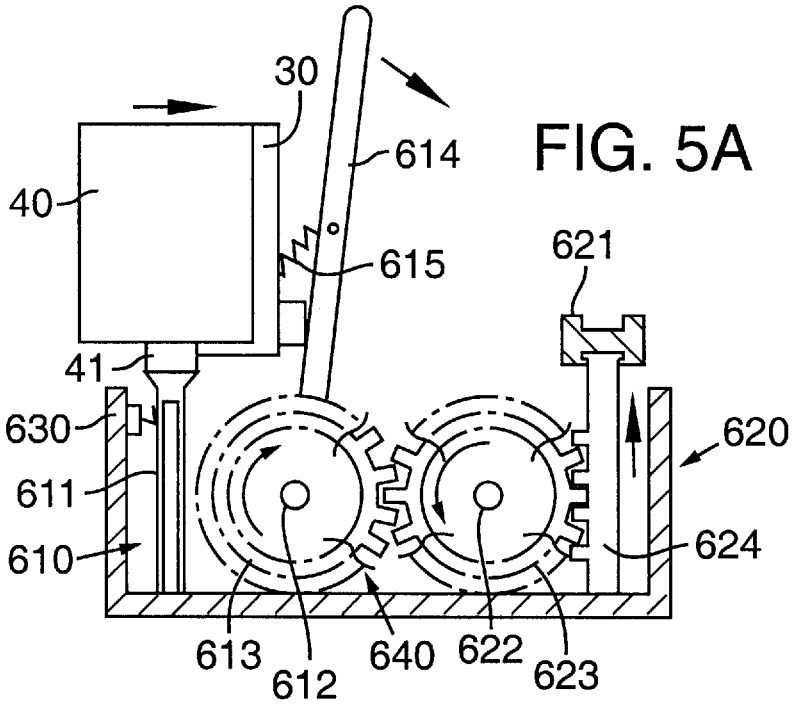
FIGS. 5A and 5B are operational views showing the cleaning and closing states of the service station device according to the first embodiment of the present invention.

FIG. 5A shows the operating procedure of cleaning nozzle 41, in which, after the printing is performed via nozzle 41 of head 40 while carriage 30 mounted with head 40 is moved side to side, carriage 30 is moved toward service station part 60 installed to the service area for preparing the following printing operation. Then, nozzle 41 of head 40 loaded onto carriage 30 becomes in contact with wiper 611 to be cleaned.

Figure 5B:
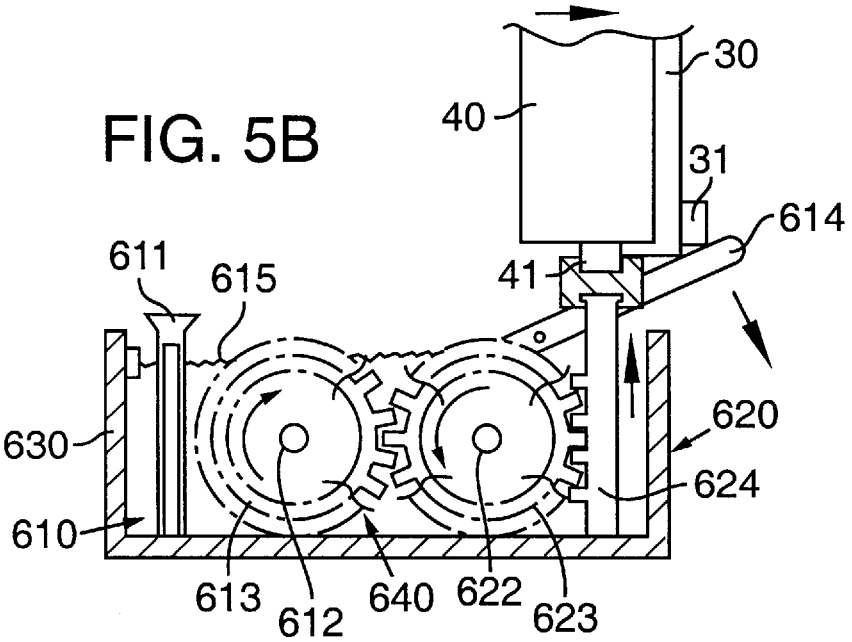

FIG. 5B shows the operating procedure of closing nozzle 41, in which nozzle 41 cleaned by means of wiper 611 is continuously moved toward cap 621. Therefore, pressurizing lug 31 of carriage 30 pushes operating lever 614 of cleaning part 610.

At this time, since operating lever 614 is integrally formed with wiper gear 613 and, at the same time, wiper gear 613 is installed to case 630 to rotate about shaft pin 612, operating lever 614 and wiper gear 613 simultaneously rotate clockwise by the pressurizing force imposed upon operating lever 614.

Accordingly, when wiper gear 613 is rotated clockwise, cap gear 623 of closing part 620 brought into meshing engagement with wiper gear 613 is simultaneously rotated counter-clockwise. At the same time, operating lever 614 rotates while being bent aside, so that elastic member 615 expands to be long in spite of its own elasticity.

Here, in order to set the contact speed of wiper 611 and head 40 to be more than a preset level, the contact portion between head 40/carriage 30 and operating lever 614 is preferably farther than the contact portion of head 40 and wiper 611 from the center of operating lever 614.

Consequently, pressurizing lug 31 is to project from carriage 30 to permit operating lever 614 to contact pressurizing lug 31 without directly contacting carriage 30, so that the distance from the center of operating lever 614 to the contact portion is to be lengthened.

Meanwhile, the counter-clockwise rotating motion of cap gear 623 ascends vertical rack 624 in mesh with cap gear 623 in the vertical direction, and cap 621 installed to the upper end of vertical rack 624 is put on nozzle 41 of head 40 moved toward cap 621 by the ascending of vertical rack 624, thereby closing nozzle 41.

At this time, elastic member 615 further expands as many as the rotating angle of operating lever 614.

When the printing operation is performed again after executing the cleaning and closing operations as above, carriage 30 mounted with head 40 is moved to the printing area. Thus, since carriage 30 is distanced from operating lever 614 of cleaning part 610, the pressurizing force imposed upon operating lever 614 is eliminated.

Therefore, the pulling elasticity of expanding elastic member 615 is operated to return operating lever 614 to the original state, and wiper gear 613 is rotated counter-clockwise by the returning force of elastic member 615 to be automatically returned to the original state while the clockwise rotating motion of cap gear 623 and resulting ascending operation of vertical rack 624 are simultaneously carried out, thereby returning all parts to the original neutral state (of FIG. 4) position.

FIG. 6 illustrating a second embodiment of the present invention represents the neutral state during performing the printing operation, in which, by the elasticity of elastic member 615, operating lever 614 is in the perpendicular state, wiper 611 is slanted by as many as a preset angle and cap 621 maintains the descending state.

Figure 7A:
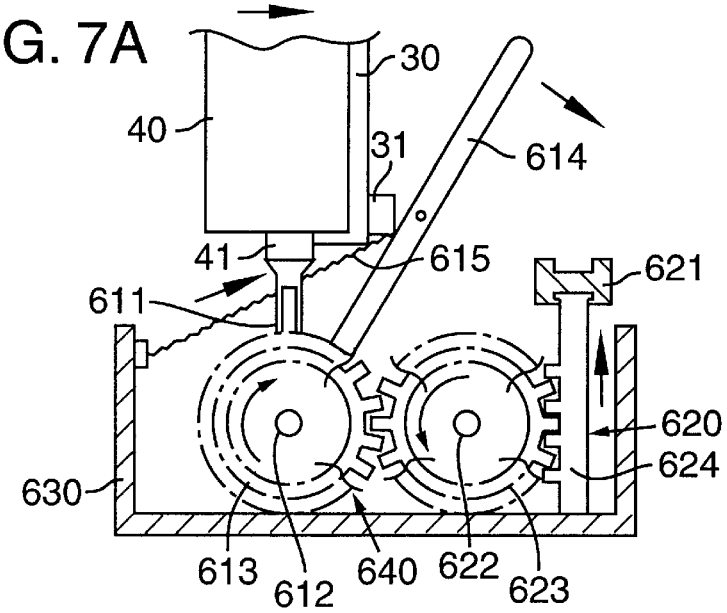
FIGS. 7A and 7B are operational views showing the cleaning and closing states of the service station device according to the second embodiment of the present invention.

FIG. 7A shows the operating procedure of cleaning nozzle 41 according to the second embodiment, in which, after the printing is performed via nozzle 41 of head 40 while carriage 30 mounted with head 40 is moved side to side, carriage 30 is placed to the service area for preparing the succeeding printing. Then, pressurizing lug 31 of carriage 30 pushes operating lever 614 of cleaning part 610 under the pressurizing state.

At this time, operating lever 614 is integrally formed with wiper gear 613, and wiper gear 613 is installed to case 630 for being rotatable about shaft pin 612. For this construction, operating lever 614 and wiper gear 613 simultaneously rotate by the pressuring force imposed upon operating lever 614, and wiper 611 installed to be integrally fixed to wiper gear 613 is rotated simultaneously.

Wiper gear 613 rotates cap gear 623 of closing part 620 in mesh with wiper gear 613 when performing the clockwise rotating motion. At this time, elastic member 615 expands by the rotating force of operating lever 614 regardless of its own elasticity.

Thus, wiper 611 becomes erected in the vertical direction after being slanted by the present angle to thereby clean nozzle 41 of head 40 moved.

Figure 7B:
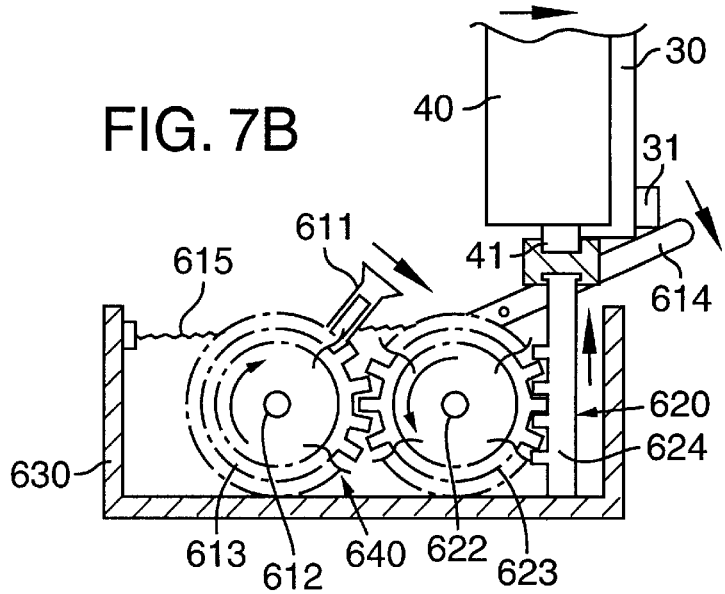

FIG. 7B shows the operating procedure of closing nozzle 41 according to the second embodiment. Here, since nozzle 41 cleaned by wiper 611 is continuously moved toward cap 621, pressurizing lug 31 of carriage 30 further pushes operating lever 614. At the same time, wiper gear 613 is further rotated to further rotate cap gear 623 counter-clockwise by centering about shaft pin 622.

By this operation, vertical rack 624 in mesh with cap gear 623 is moved upward by the counter-clockwise rotating motion of cap gear 623, and the ascending of vertical rack 624 permits cap 621 installed to the upper end of vertical rack 624 to cover and close nozzle 41 of head 40 which is moved toward cap 621.

When the printing is performed again after executing the cleaning and closing operations, carriage 30 mounted with head 40 is moved to the printing area. Thus, carriage 30 is to be distanced from operating lever 614 of cleaning part 610 to eliminate the pressurizing force imposed upon operating lever 614.

Consequently, the pulling elasticity of expanding elastic member 615 is operated to return operating lever 614 to the original state, and wiper gear 613 is rotated counter-clockwise by the returning force of elastic member 615 to be automatically returned to the original state while the clockwise rotating motion of cap gear 623 and resulting descending operation of vertical rack 624 are simultaneously carried out, thereby returning all parts to the original neutral state (of FIG. 6) position.

Rotating force transmitting part 640 of the service station device in the first and second embodiments of the present invention involves a condition that the moving speed of carriage 30 mounted with head 40 is to be accurately matched with the ascending speed of vertical rack 624 of closing part 620. Also, FIG. 8 illustrates one decelerating unit for adjusting the speed stated as above.

Here, wiper gear 613 transmits the force to first decelerating gear 641 in mesh therewith while wiper gear 613 is rotated, in which, since wiper gear 613 has smaller diameter and gear number than those of first decelerating 641, the rotating speed of first decelerating gear 641 is decelerated to be slower than that of wiper gear 613 by the proportion, and transmission gear 642 integrally formed with first decelerating gear 641 is simultaneously rotated in the same rotating speed as first decelerating gear 641.

Furthermore, the rotating speed decelerated by being transmitted to transmission gear 642 is delivered to further decelerate second decelerating gear 643 in mesh therewith. Also, since the rotating speed of second decelerating gear 643 is transmitted to cap gear 623, cap gear 623 of closing part 620 is rotated counter-clockwise. At this time, the rotating speed of cap gear 623 is decelerated to be slower than wiper gear 613.

By doing so, after head 40 is moved onto the position of closing part 620, vertical rack 624 in mesh with cap gear 623 ascends to attain the operating speed control of covering cap 621 upon nozzle 41.

In addition to the speed control by the decelerating unit of rotating force transmitting part 640 according to the present invention described as above, the speed can be controlled by the speed augmenting (or accelerating ) unit. Modifications of the above-mentioned decelerating unit and speed-augmenting unit may be effected in accordance with the capacity and other conditions of the printer. For this reason, the moving speed of head 40 having nozzle 41 and the ascending speed of cap 621 of closing part 620 can accurately correspond to each other, thereby accurately accomplishing the closing operation.

The above-described service station device according to the present invention is effective as follows.

First, in order to drive wiper 611 and cap 621, the driving part for driving them is formed by cleaning part 610 having wiper gear 613, operating lever 614 and wiper 611, and closing part 620 having cap gear 623, vertical rack 624 and cap 621. Therefore, carriage 30 moved side to side is utilized during performing the printing operation to sequentially carry out the cleaning and closing functions. Thus, the structure is simplified and the assembling operation is shortened to improve the manufacturing efficiency while economizing the cost.

Second, the construction of the driving part for driving wiper 611 and cap 621 is simplified to contrive minimization of the printer.

Third, the stroke span of the driving part for driving wiper 611 and cap 621 becomes short to reduce the cleaning and closing operation time, thereby devising the fast printing operation and providing the inkjet printer with improved function.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. In a service station device having a wiper and a cap part of an inkjet printer which includes a carriage part formed by a head and a carriage reciprocating for performing a printing operation, said service station device of a head for inkjet printer comprising:

said service station being placed to an outer portion of a printing area;

said wiper for cleaning said head while said carriage part is moved to a service area;

an operating lever moved by the movement of said carriage part to said service area;

an elastic member for returning said operating lever when said carriage part is moved to said printing area;

a rotating force transmitting part for changing the movement of said operating lever into a rotating force to transmit said rotating force;

said cap part reciprocating by said rotating force transmitted from said rotating force transmitting part to be in contact with a head surface by ascending when said carriage part is moved to said service area.

2. A service station device of a head for inkjet printer as claimed in claim 1, wherein said wiper receives said rotating force from said rotating force transmitting part formed by a gear group for cleaning said head surface when said carriage part is moved to said service area.

3. A service station device of a head for inkjet printer as claimed in claim 1, wherein said rotating force transmitting part further comprises accelerating or decelerating means formed by accelerating or decelerating gears.

4. A service station device of a head for inkjet printer as claimed in claim 1, wherein said rotating force transmitting part is comprised of a gear group having gears partially.

5. A service station device of a head for inkjet printer as claimed in claim 1, wherein said cap part comprises:

a vertical rack performing a reciprocating motion;

a cap fixedly installed to an upper end of said vertical rack for closing a nozzle of said head; and a guide for confining said vertical rack to up and down movement.

6. A service station device of a head for inkjet printer as claimed in claim 1, wherein a nozzle of said head is cleaned by said wiper when said carriage part is moved to said service area.

7. A service station device of a head for inkjet printer comprising:

a pair of gears installed to be rotatable to one side of a case for being brought into meshing engagement with each other to be simultaneously rotated in the opposite directions, one gear integrally provided with protruding cleaning means, the other gear having one side brought into meshing engagement with closing means; and driving means projecting to either one of said gears to transmit a driving force of said pair of gears for performing cleaning and closing operations of said head by means of a pressurizing force of a carriage moved.

8. A service station device of a head for inkjet printer as claimed in claim 7, wherein said driving means is comprised of an operating lever which forms a predetermined angle and is disposed to an upper portion of said cleaning means to be farther than from said head.

* * * * *